United States Patent [19]

Theurer

[11] Patent Number: 4,611,541

[45] Date of Patent: Sep. 16, 1986

[54] BALLAST CLEANING METHOD AND MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 674,003

[22] Filed: Nov. 23, 1984

[30] Foreign Application Priority Data

Jan. 31, 1984 [AT] Austria ..... 311/84

[51] Int. Cl.[4] ..... E01B 27/10

[52] U.S. Cl. ..... 104/2; 104/9; 171/16

[58] Field of Search ..... 104/2, 7 R, 7 A, 9; 171/16

[56] References Cited

U.S. PATENT DOCUMENTS

| | | | |
|---|---|---|---|
| 3,691,957 | 9/1972 | Plasser et al. | 104/9 |
| 3,699,894 | 10/1972 | Plasser et al. | 104/2 |
| 3,850,251 | 11/1974 | Plasser et al. | 171/16 |
| 4,152,989 | 5/1979 | Theurer et al. | 104/2 |
| 4,186,804 | 2/1980 | Theurer et al. | 104/7 R X |
| 4,355,687 | 10/1982 | Theurer et al. | 171/16 |
| 4,418,625 | 12/1983 | Allmer | 104/9 |

FOREIGN PATENT DOCUMENTS

| | | | |
|---|---|---|---|
| 466400 | 1/1975 | Austria | 104/9 |

*Primary Examiner*—Randolph A. Reese

*Attorney, Agent, or Firm*—Kurt Kelman

[57] ABSTRACT

Railroad track ballast is cleaned with a continuously advancing ballast cleaning machine along a section of the track ahead of, at and behind an obstacle extending along a shoulder of the track while the machine continuously advances by detaching and removing a number of the ties between the two spaced apart undercarriages of the machine, laterally pivoting the excavating chain on the machine ahead of the obstacle to move the transverse ballast excavating chain stringer away from the obstacle towards the track axis, continuing excavating, receiving and delivering the ballast to the cleaning installation on the machine, cleaning the ballast, returning the cleaned component and removing the waste component while continuously advancing the machine, laterally pivoting the excavating chain behind the obstacle until the transverse excavating chain stringer is substantially centered with respect of the track axis, and continuously re-inserting and fastening the ties to the rails in said section of the track where the ties are supported on the cleaned ballast component.

8 Claims, 4 Drawing Figures

BALLAST CLEANING METHOD AND MACHINE

The present invention relates to a method of cleaning ballast supporting a railroad track consisting of two rails fastened to a succession of ties, successive ones of the ties defining cribs therebetween and the track having a longitudinal axis extending centrally between the rails, which comprises the steps of continuously advancing a ballast cleaning machine supported on two spaced apart undercarriages along the track in an operating direction, continuously and sequentially excavating the ballast with an endless ballast excavating and conveying chain laterally and vertically pivotally supported on the machine, the chain including a transverse ballast excavating stringer extending below the track, receiving and delivering the excavated and conveyed ballast along the track axis to a ballast cleaning installation on the machine, separating the ballast into a cleaned component and a waste component in the ballast cleaning installation, returning the cleaned component to a section of the track which has been excavated by the chain stringer immediately behind the stringer in the operating direction, and removing the waste component. It also relates to a ballast cleaning machine for carrying out such a method.

U.S. Pat. No. 4,355,687, dated Oct. 26, 1982, discloses such a ballast cleaning method and machine. This machine comprises a frame supported on two spaced apart undercarriages for continuously advancing along the track in an operating direction, an endless ballast excavating and conveying chain laterally and vertically pivotally supported on the machine for continuously and sequentially excavating the ballast, receiving and delivering the excavated and conveyed ballast along the track axis to a vibratory ballast cleaning installation on the machine, the chain including a transverse ballast excavating stringer extending below the track and the ballast being separated into a cleaned component and a waste component in the ballast cleaning installation, laterally pivotal conveyors for returning the cleaned component to a section of the track which has been excavated by the chain stringer immediately behind the stringer in the operating direction, and conveyor means for removing the waste component. Two short planing chains may be laterally pivoted under the track for planing the returned cleaned ballast component. This type of ballast cleaning machine has been operated with great success but it requires sufficient clearance at the end of the ties along the track shoulder to enable the longitudinally extending stringer of the ballast excavating chain, which extends upwardly from the end of the transverse chain stringer, to move along the shoulder as the machine advances continuously. When a fixed obstacle on the shoulder, such as a station platform, a concrete walk or the like, is encountered in the path of the advancing ballast excavating chain, the chain must be temporarily dismantled and then be assembled again after the obstacle has been passed to resume the ballast cleaning operation. The ballast of track sections along which an obstacle extends can, therefore, not be cleaned with such machines.

U.S. Pat. No. 3,699,894, dated Oct. 24, 1972, relates to the continuous replacement of an old track by a new track with a track renewal train. In such a track renewal operation, the rails of the old track are detached and lifted off the ties in the front half of the train, the ballast is cleaned by a ballast cleaning machine in the center of the train in a trackless section, the cleaned ballast component is deposited on the cleared subgrade in this section and compacted and planed with two full-track vehicles forming part of the train, whereupon new ties are laid on the compacted and planed ballast and new rails are fastened thereto so that the rear end of the track renewal train runs on the new track. The ballast cleaning itself takes place in a section without any track, as is available only in a track renewal operation.

It is the primary object of this invention to improve continuously proceeding ballast cleaning along an existing track so that it may continue unhindered along the section of the track where a fixed obstacle extends along the shoulder whereby economical and trouble-free ballast cleaning is assured.

In a ballast cleaning method of the first-indicated type, this and other objects are accomplished by detaching and removing a number of the ties between the undercarriages along a section of the track ahead of, at and behind an obstacle extending along a shoulder of the track while the machine continuously advances, laterally pivoting the excavating chain ahead of the obstacle to move the transverse ballast excavating chain stringer away from the obstacle towards the track axis, continuing excavating, receiving and delivering the ballast to the cleaning installation, cleaning the ballast, returning the cleaned component and removing the waste component while continuously advancing the machine, laterally pivoting the excavating chain behind the obstacle until the transverse excavating chain stringer is substantially centered with respect of the track axis, and continuously re-inserting and fastening the ties to the rails in said section of the track where the ties are supported on the cleaned ballast component.

The first-described ballast cleaning machine is modified according to the invention to carry out this method by incorporating therein means for detaching and removing a number of the ties between the undercarriages along a section of the track ahead of, at and behind an obstacle extending along a shoulder of the track while the machine continuously advances, hydraulically operated drive means for selectively laterally pivoting the excavating chain ahead of the obstacle into selected positions wherein a respective end of the transverse excavating chain stringer is immediately adjacent a respective one of the rails adjacent the shoulder to move the transverse ballast excavating chain stringer away from the obstacle towards the track axis and for laterally pivoting the excavating chain behind the obstacle until the transverse excavating chain stringer is substantially centered with respect of the track axis, and means for continuously re-inserting and fastening the ties to the rails in said section of the track where the ties are supported on the cleaned ballast component.

With the above method and machine, it has become possible for the first time to clean ballast along track sections where fixed obstacles extend at the shoulder without interrupting the continuously proceeding ballast cleaning operation. This enables the usually heavily encrusted ballast to be cleaned unhindered in the area of railroad stations where the prevalence of switches makes such cleaning particularly important but where fixed obstacles, such as platforms or walks are often found along one of the track shoulders. In this case, the present invention enables the ballast excavating chain to be swung out of the path of the obstacle at the shoulder if there is sufficient clearance at the opposite shoulder. The more homogenous and cleaned condition of the ballast makes it possible subsequently to tamp the ballast to provide a more uniform ballast bed support and a long-lasting stabilization of the track. In addition, no time is wasted in dismantling the ballast excavating chain ahead of the obstacle and then assembling it again after the obstacle has been passed. Therefore, the efficiency of the ballast cleaning operation is considerably enhanced and the operation can be effected during shorter intervals between passing trains. The ties may be detached and removed continuously ahead of the transverse ballast excavating chain stringer and then slid in again between the cleaned ballast and the rails.

The above and other objects, advantages and features of the present invention will become more apparent from the following detailed description of a now preferred embodiment thereof, taken in conjunction with the partially schematic drawing wherein FIG. 1 is a side elevational view of a ballast cleaning machine according to the invention for carrying out the ballast cleaning method;

Figure 1:
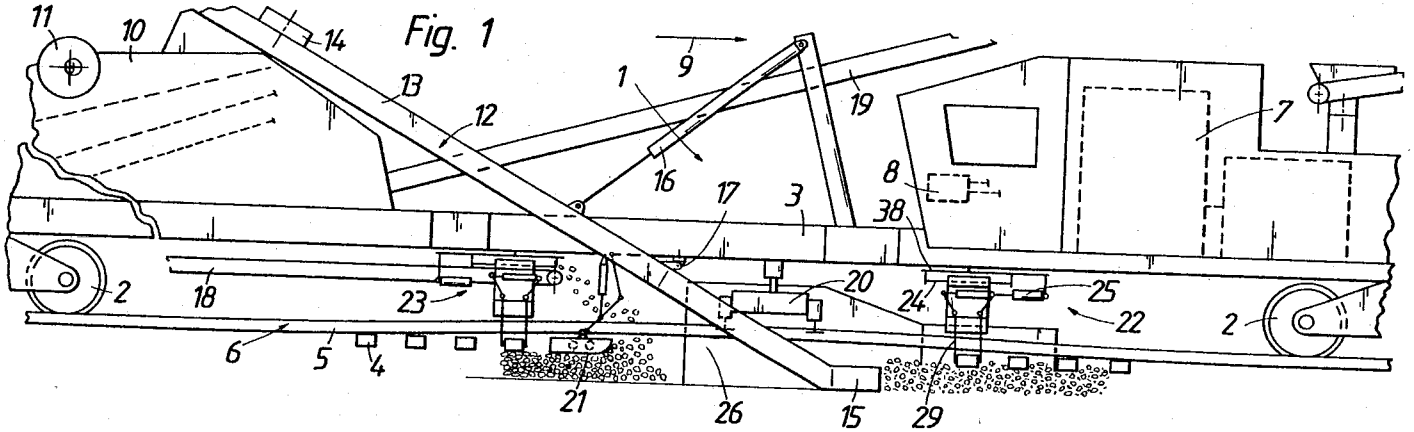
Figure 2:
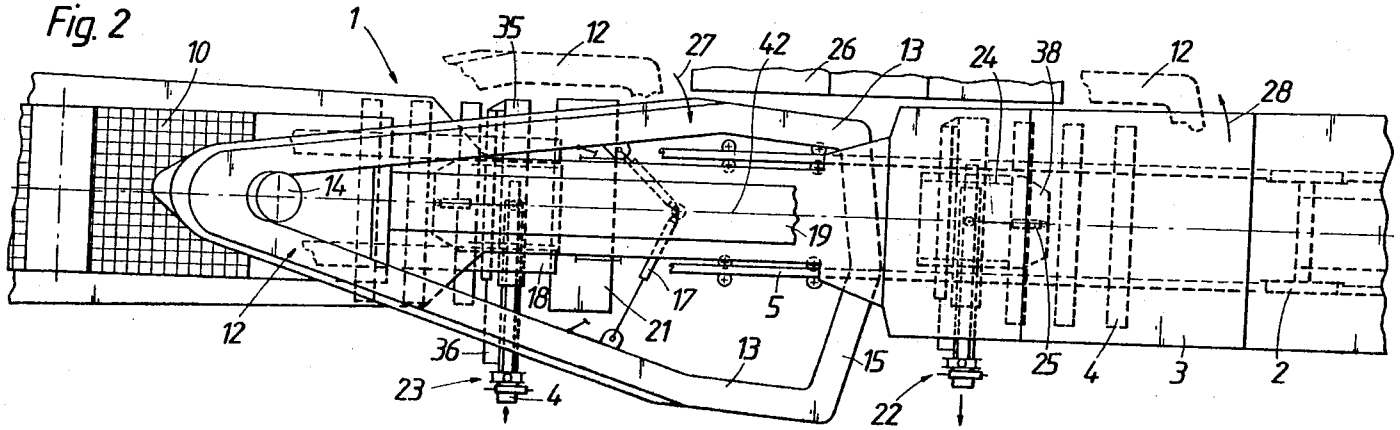
FIG. 2 is a plan view of the machine of FIG. 1.

Referring now to the drawing and first to FIGS. 1 and 2, there is shown machine 1 for cleaning ballast supporting railroad track 6 consisting of two rails 5 fastened to a succession of ties 4. Successive ties define cribs therebetween and track 6 has longitudinal axis 42 extending centrally between rails 5. The ballast cleaning machine has frame 3 supported on two spaced apart undercarriages 2, 2 for continuously advancing along track 6 in an operating direction indicated by arrow 9. Power plant 7 on the machine comprises a motor coupled to pressure generator means and is connected to control means 8 for operating the machine in a well known manner. Generally conventional endless ballast excavating and conveyor chain 12 is laterally and vertically pivotally supported on machine frame 3 for continuously and sequentially excavating the ballast, receiving and delivering the excavated and conveyed ballast along the track axis to a ballast cleaning installation on the machine frame. The endless ballast excavating chain includes transverse ballast excavating stringer 15 extending below the track and from the ends of which raise two lateral, longitudinally extending stringers 13 which merge at an upper end of the chain in alignment with the track axis and where the endless chain is trained about drive 14 which continuously moves the chain to convey the excavated ballast along one of the longitudinally extending stringers to the upper end where it is received and delivered to the ballast cleaning installation consisting of screening apparatus 10 vibrated by vibrating drive 11, the ballast being separated into a cleaned component and a waste component in the ballast cleaning installation. The pivotal support of endless ballast excavating chain 12 on machine frame 3 is provided by hydraulically operated drive means consisting of cylinder-piston drives 16, 17, drives 17 being arranged for selectively laterally pivoting the excavating chain ahead of obstacle 26 into selected positions wherein a respective end of transverse excavating chain stringer 15 is immediately adjacent a respective rail 5 adjacent the shoulder along which the obstacle extends to move the transverse excavating chain stringer away from obstacle 26 towards track axis 42 and for laterally pivoting the excavating chain behind obstacle 26 until transverse excavating chain stringer 15 is substantially centered with respect to the track axis. The centered position of endless ballast excavating chain 12 ahead of, and behind, obstacle 26 is schematically indicated in FIG. 2 in broken lines while the pivoted position, wherein the obstacle no longer is in the path of the excavating chain, is shown in full line in this figure. As shown in FIG. 2, when the excavating chain is pivoted in the direction of arrow 27, the lower end of longitudinally extending stringer 13 is substantially aligned with rail 4 adjacent obstacle 26 and can pass by this obstacle.

Laterally pivotal conveyor means consisting of two laterally pivotal conveyor bands 18 are arranged to receive the cleaned ballast component from vibratory ballast screening apparatus 10 and have output ends adjacent a section of the track which has been excavated by transverse chain stringer 15 for returning the cleaned ballast component immediately behind stringer 15 in the operating direction. Furthermore, conveyor means consisting of elongated conveyor band 19 is mounted on machine frame 3 along the track axis for removing the waste component.

According to this invention, machine 1 comprises means 22 for removing a number of ties 4 between undercarriages 2, 2 along a section of the track ahead of, at and behind obstacle 26 extending along a shoulder of track 6 while the machine continuously advances, and means 23 for continuously re-inserting the ties in this track section where the ties are supported on the cleaned ballast component. The illustrated means for removing and re-inserting ties 4 comprises tie replacement devices 22 and 23 arranged, respectively, immediately ahead of transverse ballast excavating stringer 15, in the operating direction, and adjacent the output end of laterally pivotal conveyor bands 18. Guide means consisting of guides 24 on machine frame 3 support tie replacement devices 22, 23 for longitudinal displacement thereon. The guides preferably have a length corresponding to at least twice the width of ties 4 and power drives consisting of cylinder-piston drives 25 are connected to the tie replacement devices for longitudinal displacement thereof.

Vertically adjustable track lifting device 20 is mounted on machine frame 3 between tie replacement devices 22, 23 and vertically adjustable device 21 for planing the returned cleaned ballast component is mounted on the machine frame behind the track lifting device. A linkage connects device 21 to the machine frame for laterally inserting the planing device for planing engagement with the returned cleaned ballast component under the track, as shown in FIG. 1.

The automatic removal and re-insertion of the ties by tie replacement devices assures rapid removal and insertion of the ties ahead and behind the obstacle while the ballast cleaning machine continues its unhindered advance, even if the ties should firmly sit in heavily encrusted ballast. The ties will be re-inserted at a uniform spacing while the ballast cleaning operation proceeds at high efficiency. The longitudinally displaceable tie replacement devices may be readily retrofitted on existing ballast cleaning machines without interfering with the conventional ballast excavating, cleaning and redistributing installations on such machines. The displacement of these devices in the operating direction enables the machine to advance continuously while the device grips a stationary tie. Where the longitudinal guides for the tie replacement devices have a length corresponding at least to twice the width of the ties, the ties may be removed and replaced without any interruption of the advance of the machine. The longitudinal displacement of the tie replacement devices enables the ties to be fully withdrawn from, and inserted below, the track rails during the continuous advance of the machine, the removal of the ties enabling the ballast excavating chain to be freely pivoted in a lateral direction. The track lifting device between the tie replacement devices prevents the track rails from sagging, which may interfere with the operation of the ballast excavating chain, and also facilitates the disposition of the ties under the lifted rails. The planing means assures a level and even support for the re-attached ties. The power drives connected to the tie replacement devices enable the devices to be longitudinally displaced rapidly and accurately immediately after the respective ties have been withdrawn and inserted, respectively, to be centered over the next tie to be replaced.

Figure 3:
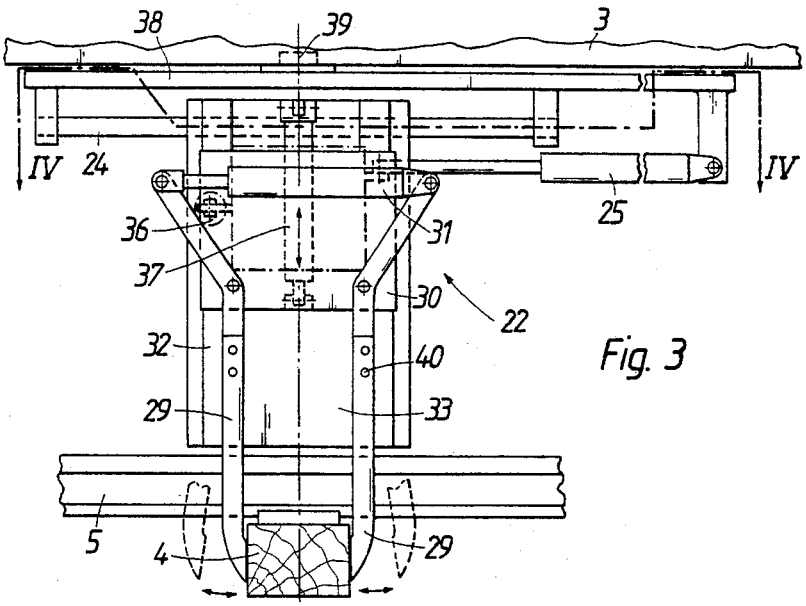
FIG. 3 is an enlarged side elevational view of the front tie replacement device of this machine.
Figure 4:
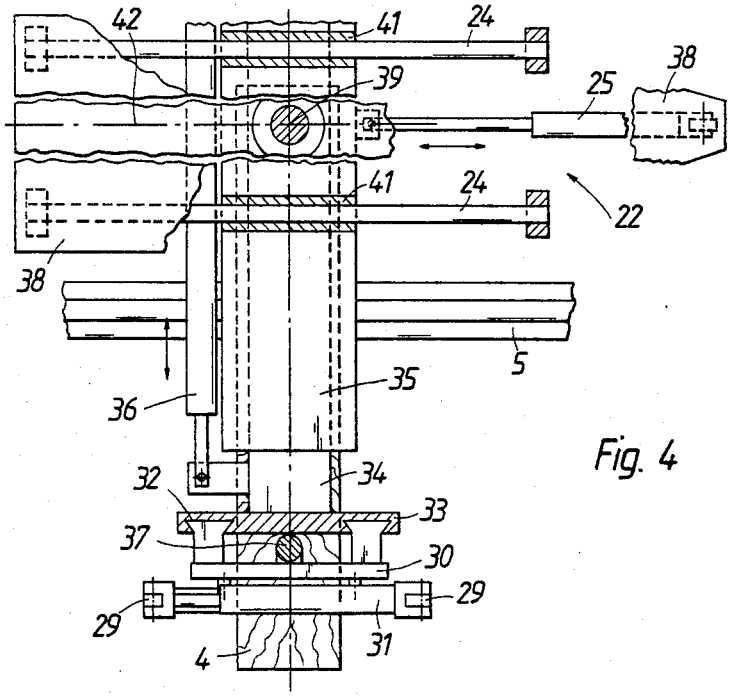
FIG. 4 is a top view taken along section line IV—IV of FIG. 3.

Tie replacement device 22 illustrated in FIGS. 3 and 4 comprises base plate 33, telescopingly displaceable strut 34 connected to the base plate, carrier plate 30 mounted on guides 32 on base plate 33 for vertical displacement, and a pair of pivotal tie clamping tongs 29, 29 mounted on carrier plate 30. The base plate and the carrier plate are spaced from each other in a direction transverse to machine frame 3 and vertical displacement drive 37 is arranged between the plates, one end thereof being connected to the base plate and the other end to the carrier plate. As shown, the tie replacement device is longitudinally displaceably supported on a pair of guides 24 and tongs 29 are mounted on carrier plate 30 by respective pivots for pivoting in a vertical plane extending parallel to the track rails. Cylinder-piston drive 31 links the clamping tongs together for reciprocation in this plane. Clamping tongs 29 consist of two parts detachably connected by bolts 40. Base plate 33 defines dove-tailed guides 32 receiving straps connected to carrier plate 30 so that the carrier plate may be vertically displaced along the base plate. Strut 34 of rectangular cross section is connected to base plate 33 and is telescopingly received in sleeve 35 for guidance therein when cylinder-piston drive 36 is operated for displacement of the carrier plate in a transverse direction. The piston rod of drive 36 is affixed to a bracket on strut 34 while the cylinder of the drive is connected to the opposite end of sleeve 35. The guides 24 are affixed to plate 38 which is rotatably mounted on the underside of machine frame 3 for rotation about vertical axis 39 passing through track axis 42 to enable the tie replacement device to be positioned over the opposite track rail by pivoting plate 38 180° axis 39. To enable this pivoting movement to be executed unhindered, bolts 40 are detached and the lower parts of tongs 29 are removed, thus permitting the tie replacement device to be turned between machine frame 3 and track 6 from one track rail to the opposite track rail. The cylinder of longitudinal displacement drive 25 is linked to rotatable plate 38 while its piston rod is linked to sleeve 35 of the tie replacement device. Lugs 41 are arranged on the upper side of sleeve 35 for receiving guides 24 for the longitudinal displacement of the tie replacement device.

The vertical displacement of the tie clamping tongs carrier plate with respect to the base plate enables the tie replacement device to be of a low structure so that it may be longitudinally displaced without hindrance and also turned by 180° for operation at both rails, depending on the location of the obstacle at either shoulder. The illustrated longitudinal displacement bearing provides a very robust support without interfering with the telescoping displacement movement of strut 34 with respect to sleeve 35.

The operation of the illustrated ballast cleaning machine will partially be obvious from the above description of its structure and the method of cleaning ballast with this machine will be described in detail hereinafter.

After transverse ballast excavating chain stringer 15 has been inserted in a previously excavated transverse channel in the ballast bed below the track and ballast excavating chain 12 has been properly centered with respect to track axis 42 so that the insides of the lower ends of longitudinally extending chain stringers 13 are spaced a short distance from the ends of ties 4, the operation is started by continuously advancing ballast cleaning machine 1 along track 6 in an operating direction indicated by arrow 9. While the machine continuously advances, the ballast is continuously and sequentially excavated with endless ballast excavating chain 12 and delivered along track axis 42 to ballast cleaning installation 10 where it is separated into a cleaned component and a waste component. The cleaned component is returned to a section of the track which has been excavated by transverse chain stringer 15 immediately behind the chain stringer in the operating direction and the waste component is removed.

When the machine approaches an obstacle 26, such as a station platform, a walk or the like, extending along a shoulder of track 6 so close to the tie ends that it prevents passage of the ballast excavating chain while the machine continuously advances, a number of ties 4 between undercarriages 2, 2 along a section of the track ahead of, at and behind obstacle 26 are removed. For this purpose, an advance work crew removes the bolts or spikes fastening the rails to the ties between four to six cribs ahead of the obstacle before the machine reaches the obstacle. As soon as front tie replacement device 22 has reached the first loosened tie 4, it is gripped by clamping tongs 29 and transverse displacement drive 36 is operated to withdraw the tie gripped by tongs 29 to the shoulder of the track opposite to the shoulder on which obstacle 26 is located. During this removal of the tie, longitudinal displacement drive 25 idles so that the tie replacement device may be freely displaced longitudinally along guides 24 while machine 1 continues to advance. Immediately after the tie has been deposited on the opposite shoulder or on the machine frame, drive 36 is reversed to withdraw strut 34 into sleeve 35 while drive 25 is operated for the longitudinal displacement of the tie replacement device into its front position wherein it is centered over the next succeeding tie to be removed. This operation is repeated, successive ones of the ties immediately preceding the transverse chain stringer being then sequentially laterally removed and re-inserted behind the transverse chain stringer in the track section where the re-inserted ties are supported on the cleaned ballast component until between four to six cribs behind the obstacle have been reached, and the excavating chain is centered again.

With this continuous and sequentially proceeding removal of successive ties ahead of transverse ballast excavating chain stringer 15 and the immediately succeeding re-insertion of the ties behind this chain stringer, a tie renewal zone which continuously advances with the chain stringer is created as the chain stringer excavates successive zones of ballast. This enables the lower end of the longitudinally extending excavating chain stringer to pass between the end of the transverse chain stringer and the obstacle when ballast excavating chain 12 has been swung towards track axis 42 in the tie renewal zone. In this way, the continuous ballast cleaning operation can proceed unhindered as the machine passes the obstacle at the shoulder. As soon as the obstacle has been passed, pivoting drives 17 are operated to swing the ballast excavating chain back into its centered position, as indicated by arrow 28 in FIG. 2. In this track section, no ties are removed by tie replacement device 22 while tie replacement device 23 remains in operation until the last removed tie has been re-inserted.

Tie replacement devices 22, 23 could be omitted, if desired, and the ties between undercarriages 2, 2 may be removed and re-inserted manually.

What is claimed is:

1. A method of cleaning ballast supporting a railroad track consisting of two rails fastened to a succession of ties, successive ones of the ties defining cribs therebetween and the track having a longitudinal axis extending centrally between the rails, which comprises the steps of (a) continuously advancing a ballast cleaning machine supported on two spaced apart undercarriages along the track in an operating direction, (b) continuously and sequentially excavating the ballast with an endless ballast excavating and conveying chain laterally and vertically pivotally supported on the machine, the chain including a transverse ballast excavating stringer extending below the track, receiving and delivering the excavated and conveyed ballast along the track axis to a ballast cleaning installation on the machine, (c) separating the ballast into a cleaned component and a waste component in the ballast cleaning installation, (d) returning the cleaned component to a section of the track which has been excavated by the chain stringer immediately behind the stringer in the operating direction, (e) removing the waste component, and the improvement comprising the steps of (f) removing a number of the ties between the undercarriages along a section of the track ahead of, at and behind an obstacle extending along a shoulder of the track while the machine continuously advances, (g) laterally pivoting the excavating chain ahead of the obstacle to move the transverse ballast excavating chain stringer away from the obstacle towards the track axis, (h) continuing excavating, receiving and delivering the ballast to the cleaning installation, cleaning the ballast, returning the cleaned component and removing the waste component while continuously advancing the machine, (i) laterally pivoting the excavating chain behind the obstacle until the transverse excavating chain stringer is substantially centered with respect of the track axis, and (j) continuously re-inserting the ties in said section of the track where the ties are supported on the cleaned ballast component.

2. The ballast cleaning method of claim 1, wherein the cleaned ballast component in said track section is planed.

3. The ballast cleaning method of claim 1, wherein the ties between four to six cribs ahead of the obstacle and in front of the continuously advancing transverse chain stringer are laterally removed while the machine continuously advances in the operating direction, the transverse ballast excavating chain stringer is thereafter pivoted away from the obstacle towards the track axis, successive ones of the ties immediately preceding the transverse chain stringer are then sequentially laterally removed and re-inserted behind the transverse chain stringer in said track section where the re-inserted ties are supported on the cleaned ballast component until between four to six cribs behind the obstacle have been reached, and the excavating chain is centered again.

4. The ballast cleaning method of claim 1, wherein the ties are removed and re-inserted means of a respective tie replacement device longitudinally displaceably mounted on the machine.

5. A machine for cleaning ballast supporting a railroad track consisting of two rails fastened to a succession of ties, successive ones of the ties defining cribs therebetween and the track having a longitudinal axis extending centrally between the rails, which comprises (a) a frame supported on two spaced apart undercarriages for continuously advancing along the track in an operating direction, (b) an endless ballast excavating and conveying chain laterally and vertically pivotally supported on the machine for continuously and sequentially excavating the ballast, receiving and delivering the excavated and conveyed ballast along the track axis to a ballast cleaning installation on the machine, the chain including a transverse ballast excavating stringer extending below the track and the ballast being separated into a cleaned component and a waste component in the ballast cleaning installation, (c) laterally pivotal conveyor means for returning the cleaned component to a section of the track which has been excavated by the chain stringer immediately behind the stringer in the operating direction, (d) conveyor means for removing the waste component, and the improvement comprising (e) means for removing a number of the ties between the undercarriages along a section of the track ahead of, at and behind an obstacle extending along a shoulder of the track while the machine continuously advances, (f) hydraulically operated drive means for selectively laterally pivoting the excavating chain ahead of the obstacle into selected positions wherein a respective end of the transverse excavating chain stringer is immediately adjacent a respective one of the rails adjacent the shoulder to move the transverse ballast excavating chain stringer away from the obstacle towards the track axis and for laterally pivoting the excavating chain behind the obstacle until the transverse excavating chain stringer is substantially centered with respect of the track axis, (g) means for continuously re-inserting the ties in said section of the track where the ties are supported on the cleaned ballast component, said means comprising (1) tie replacement devices arranged, respectively, immediately ahead of the transverse ballast excavating chain stringer, in the operating direction, and adjacent an output end of the laterally pivotal conveyor means, each tie replacement device comprising a base plate, a telescopingly displaceable strut connected to the base plate, a carrier plate mounted on guides on the base plate for vertical displacement, a pair of pivotal tie clamping tongs mounted on the carrier plate, the base plate and the carrier plate being spaced from each other in a direction transverse to the machine frame, and a vertical displacement drive arranged between the plates, and (h) guide means on the machine frame supporting the tie replacement devices for longitudinal displacement thereon.

6. The ballast cleaning machine of claim 5, wherein the guide means are guides having a length corresponding at least to twice the width of the ties.

7. The ballast cleaning machine of claim 5, further comprising power drives connected to the tie replacement devices for longitudinal displacement thereof.

8. The ballast cleaning machine of claim 5, further comprising a sleeve telescopingly receiving the strut, and lugs arranged on the sleeve for receiving the guides for the longitudinal displacement of the tie replacement device.

* * * * *